US007016840B2

(12) United States Patent
Mochizuki et al.

(10) Patent No.: US 7,016,840 B2
(45) Date of Patent: Mar. 21, 2006

(54) METHOD AND APPARATUS FOR SYNTHESIZING SPEECH AND METHOD APPARATUS FOR REGISTERING PITCH WAVEFORMS

(75) Inventors: Ryo Mochizuki, Yokohama (JP); Toshiyuki Isono, Yokohama (JP); Hirofumi Nishimura, Yokohama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 723 days.

(21) Appl. No.: 09/953,989

(22) Filed: Sep. 12, 2001

(65) Prior Publication Data

US 2002/0052733 A1 May 2, 2002

(30) Foreign Application Priority Data

Sep. 18, 2000 (JP) ..... 2000-281683

(51) Int. Cl.
*G10L 13/00* (2006.01)

(52) U.S. Cl. ..... 704/258; 704/207; 704/209; 704/220

(58) Field of Classification Search ..... 704/207, 704/208, 220, 272, 258, 203, 209; 381/113
See application file for complete search history.

(56) References Cited

U.S. PATENT DOCUMENTS 5,950,152 A * 9/1999 Arai et al. ..... 704/207
6,125,346 A * 9/2000 Nishimura et al. ..... 704/258

FOREIGN PATENT DOCUMENTS

CN 1190236 A 8/1998
EP 0 848 372 A 6/1998

OTHER PUBLICATIONS

Ishikawa et al.: Speech Synthesis Software for a 32-Bit Microprocessor, IEEE Transactions on Consumer Electronics, vol. 44, No. 3, Aug. 1998, pp. 1173-1182.
Ishikawa Y et al: "Speech Synthesis Software for a 32-Bit Microprocessor" IEEE Transactions On consumer Electronics, IEEE Inc. NY , US, vol. 44, No. 3, Aug. 1998, pp. 1173-1181, XP000851637, ISSN: 0098-3063, p. 1175, column 2—p. 1176, column 1; figure 1.

* cited by examiner

*Primary Examiner*—W. R. Young
*Assistant Examiner*—Minerva Rivero
(74) *Attorney, Agent, or Firm*—Pearne & Gordon LLP

(57) ABSTRACT

A speech synthesis apparatus (10) comprises speech segment disassembling means (101) for disassembling the speech segments each including at least one phoneme into a plurality of pitch waveforms, phase characteristic transforming means (103) for transforming the phase characteristics of the pitch waveforms into a uniformed phase characteristic, pitch waveform classifying means (104) for classifying the pitch waveforms into a plurality of groups, pitch waveform registering means (106) for registering the pitch waveforms in the database (111) by extracting one pitch waveform from among the pitch waveforms in each of the groups, and synthesizing means (107) for synthesizing the speech with the pitch waveforms registered in the database (111). The speech synthesis apparatus (10) thus constructed can synthesize a natural speech using a relatively small database capacity.

10 Claims, 13 Drawing Sheets

METHOD AND APPARATUS FOR SYNTHESIZING SPEECH AND METHOD APPARATUS FOR REGISTERING PITCH WAVEFORMS

BACKGROUND OF THE INVENTION

1. Field of the Invention

The present invention relates to a speech synthesis apparatus for and a speech synthesis method of synthesizing a speech consisting of a plurality of speech segments each including at least one phoneme, and more particularly to a speech synthesis apparatus and a speech synthesis method which can synthesize a natural speech using a relatively small database capacity.

2. Description of the Related Art

In a conventional speech synthesis apparatus and a conventional speech synthesis method, a speech in a certain language is generally divided into a plurality of speech segments including at least one phoneme in the language. Further, each of the speech segments is generally disassembled into a plurality of pitch waveforms. The pitch waveforms obtained by disassembling each of the speech segments are associated with each of the speech segments and are registered in a database. The pitch waveforms in the database are used when the speech is synthesized.

One of such conventional speech synthesis method is disclosed in Japanese Patent Application Laid-Open Publication No. 171484/1998. In this conventional speech synthesis method, the pitch waveforms considered to be redundant are removed for the purpose of saving capacity of the database, and the other pitch waveforms as representatives are used to synthesize the speech.

The conventional speech synthesis method stated above, however, encounters such a problem that the database cannot store the pitch waveforms with data significantly reduced by the reason that the pitch waveforms vary in shape due to differences in their phase characteristics before synthesizing a natural speech. Another problem is that the less number of the pitch waveforms to be registered in the database for saving capacity of the database, the lower sound quality of the synthesized speech.

SUMMARY OF THE INVENTION

It is therefore an object of the present invention to provide a speech synthesis apparatus and a speech synthesis method which can synthesize a natural speech using a relatively small database capacity.

According to a first aspect of the present invention, there is provided a speech synthesis apparatus for synthesizing a speech consisting of a plurality of speech segments each including at least one phoneme, comprising; a database for storing data related to the speech segments, speech segment disassembling means for disassembling each of the speech segments into a plurality of pitch waveforms each having a phase characteristic, phase characteristic transforming means for transforming the phase characteristics of the pitch waveforms into a uniformed phase characteristic for each of the pitch waveforms, pitch waveform classifying means for classifying the pitch waveforms into a plurality of groups each consisting of a plurality of the pitch waveforms substantially identical in shape, pitch waveform registering means for registering the pitch waveforms in the database by extracting one pitch waveform from among the pitch waveforms in each of the groups, and synthesizing means for synthesizing the speech with the pitch waveforms registered in the database.

The above speech synthesis apparatus thus constructed leads to the fact that the differences in shape of the pitch waveforms are removed, thereby making it possible to reduce an amount of data in the database to a desired level. Further, the transforming operation of the phase characteristics of the pitch waveforms hardly affects the sound quality of the synthesized speech, thereby accomplishing speech synthesis with little degradation in sound quality.

According to a second aspect of the present invention, there is provided a speech synthesis apparatus which further comprises phase characteristic generating means for generating the uniformed phase characteristic based on the phase characteristics of the pitch waveforms obtained by disassembling the speech segments.

The above speech synthesis apparatus thus constructed leads to the fact that an occurrence of an unusual waveform with energy concentration such as zero phase is avoided, thereby accomplishing speech synthesis with stable sound quality.

According to a third aspect of the present invention, there is provided a speech synthesis apparatus in which the phase characteristic generating means is operative to generate the uniformed phase characteristic by averaging the phase characteristics of the pitch waveforms obtained by disassembling the speech segments.

The above speech synthesis apparatus thus constructed leads to the fact that an occurrence of an unusual waveform with energy concentration such as zero phase is avoided, and that changes in shape of the pitch waveforms can be small, thereby accomplishing speech synthesis with more stable and more natural sound quality.

According to a fourth aspect of the present invention, there is provided a speech synthesis apparatus in which the pitch waveform classifying means is operative to classify the pitch waveforms based on respective phoneme types.

The above speech synthesis apparatus thus constructed leads to the fact that the amount of the computation for classifying the pitch waveforms can be substantially decreased.

According to a fifth aspect of the present invention, there is provided a speech synthesis apparatus in which the pitch waveform classifying means is operative to classify the pitch waveforms by comparing the pitch waveforms weighted in amplitude characteristic at respective frequencies only for comparing.

The above speech synthesis apparatus thus constructed leads to the fact that it is possible to achieve less data capacity consistent with high sound quality. Particularly, not only ignoring of the differences in pitch waveform shape within unimportant frequency band, but also maintaining of the identity of the pitch waveforms within important frequency band can be achieved for less data capacity and high sound quality.

According to a sixth aspect of the present invention, there is provided a speech synthesis apparatus which further comprises pitch waveform selecting means for selecting the pitch waveforms to be registered in the database by comparing the pitch waveforms to be in neighborhood each other when the speech is assembled.

The above speech synthesis apparatus thus constructed leads to the fact that the speech can be reassembled with the continuity between the adjacent pitch waveforms maintained, thereby further reducing the degradation in sound quality.

According to a seventh aspect of the present invention, there is provided a speech synthesis method of synthesizing a speech consisting of a plurality of speech segments each including at least one phoneme, comprising the steps of; a speech segment disassembling step of disassembling each of the speech segments into a plurality of pitch waveforms each having a phase characteristic, a phase characteristic transforming step of transforming the phase characteristics of the pitch waveforms into a uniformed phase characteristic for each of the pitch waveforms, a pitch waveform classifying step of classifying the pitch waveforms into a plurality of groups each consisting of a plurality of the pitch waveforms substantially identical in shape, a pitch waveform registering step of registering the pitch waveforms in a database by extracting one pitch waveform from among the pitch waveforms in each of the groups, and a synthesizing step of synthesizing the speech with the pitch waveforms registered in the database.

The above speech synthesis method thus constructed leads to the fact that, the differences in shape of the pitch waveforms are removed, thereby making it possible to reduce an amount of data in the database to a desired level. Further, the transforming operation of the phase characteristics of the pitch waveforms hardly affects the sound quality of the synthesized speech, thereby accomplishing speech synthesis with little degradation in sound quality.

According to a eighth aspect of the present invention, there is provided a speech synthesis method which further comprises a phase characteristic generating step of generating the uniformed phase characteristic based on the phase characteristics of the pitch waveforms obtained by disassembling the speech segments.

The above speech synthesis method thus constructed leads to the fact that the occurrence of an unusual waveform with energy concentration such as zero phase is avoided, thereby accomplishing speech synthesis with stable sound quality.

According to a ninth aspect of the present invention, there is provided a speech synthesis method in which the phase characteristic generating step is of generating the uniformed phase characteristic by averaging the phase characteristics of the pitch waveforms obtained by disassembling the speech segments.

The above speech synthesis method thus constructed leads to the fact that the occurrence of an unusual waveform with energy concentration such as zero phase is avoided, and that a change in shape of the pitch waveforms can be small, thereby accomplishing speech synthesis with more stable and more natural sound quality.

According to a tenth aspect of the present invention, there is provided a speech synthesis method in which further comprises a pitch waveform previously classifying step of classifying the pitch waveforms based on respective phoneme types in advance.

The above speech synthesis method thus constructed leads to the fact that the amount of the computation for classifying the pitch waveforms can be substantially decreased.

According to a eleventh aspect of the present invention, there is provided a speech synthesis method in which the pitch waveform classifying step is of classifying the pitch waveforms by comparing the pitch waveforms weighted in amplitude characteristic at respective frequencies only for comparing.

The above speech synthesis method thus constructed leads to the fact that it is possible to achieve less data capacity consistent with high sound quality. Particularly, not only ignoring of the differences in pitch waveform shape within unimportant frequency band, but also maintaining of the identity of the pitch waveforms within important frequency band can be achieved for less data capacity and high sound quality.

According to a twelfth aspect of the present invention, there is provided a speech synthesis method which further comprises pitch waveform selecting step of selecting the pitch waveforms to be registered in the database by comparing the pitch waveforms to be in neighborhood each other when the speech is assembled.

The above speech synthesis method thus constructed leads to the fact that the speech can be reassembled with the continuity between the adjacent pitch waveforms maintained, thereby further reducing the degradation in sound quality.

According to a thirteenth aspect of the present invention, there is provided a pitch waveform registering apparatus for registering a plurality of pitch waveforms constituting a plurality of speech segments each including at least one phoneme into a database for storing data related to the speech segments, the pitch waveforms to be used for synthesizing a speech consisting of the speech segments, comprising; speech segment disassembling means for disassembling each of the speech segments into a plurality of pitch waveforms each having a phase characteristic, phase characteristic transforming means for transforming the phase characteristics of the pitch waveforms into a uniformed phase characteristic for each of the pitch waveforms, pitch waveform classifying means for classifying the pitch waveforms into a plurality of groups each consisting of a plurality of the pitch waveforms substantially identical in shape, and pitch waveform registering means for registering the pitch waveforms in the database by extracting one pitch waveform from among the pitch waveforms in each of the groups.

The above pitch waveform registering apparatus thus constructed leads to the fact that the differences in shape of the pitch waveforms are removed, thereby making it possible to reduce an amount of data in the database to a desired level. Further, the transforming operation of the phase characteristics of the pitch waveforms hardly affects the sound quality of the synthesized speech, thereby accomplishing speech synthesis with little degradation in sound quality.

According to a fourteenth aspect of the present invention, there is provided a pitch waveform registering method of registering a plurality of pitch waveforms constituting a plurality of speech segments each including at least one phoneme into a database for storing data related to the speech segments, the pitch waveforms to be used for synthesizing a speech consisting of the speech segments, comprising the steps of; a speech segment disassembling step of disassembling each of the speech segments into a plurality of pitch waveforms each having a phase characteristic, a phase characteristic transforming step of transforming the phase characteristics of the pitch waveforms into a uniformed phase characteristic for each of the pitch waveforms, a pitch waveform classifying step of classifying the pitch waveforms into a plurality of groups each consisting of a plurality of the pitch waveforms substantially identical in shape, and a pitch waveform registering step of registering the pitch waveforms in a database by extracting one pitch waveform from among the pitch waveforms in each of the groups.

The above pitch waveform registering method thus constructed leads to the fact that the differences in shape of the pitch waveforms are removed, thereby making it possible to reduce an amount of data in the database to a desired level. Further, the transforming operation of the phase characteristics of the pitch waveforms hardly affects the sound quality of the synthesized speech, thereby accomplishing speech synthesis with little degradation in sound quality.

BRIEF DESCRIPTION OF THE DRAWINGS

The features and advantages of a speech synthesis apparatus and a speech synthesis method according to the present invention will more clearly be understood from the following description taken in conjunction with the accompanying drawings in which.

DESCRIPTION OF THE PREFERRED EMBODIMENTS

Figure 1:
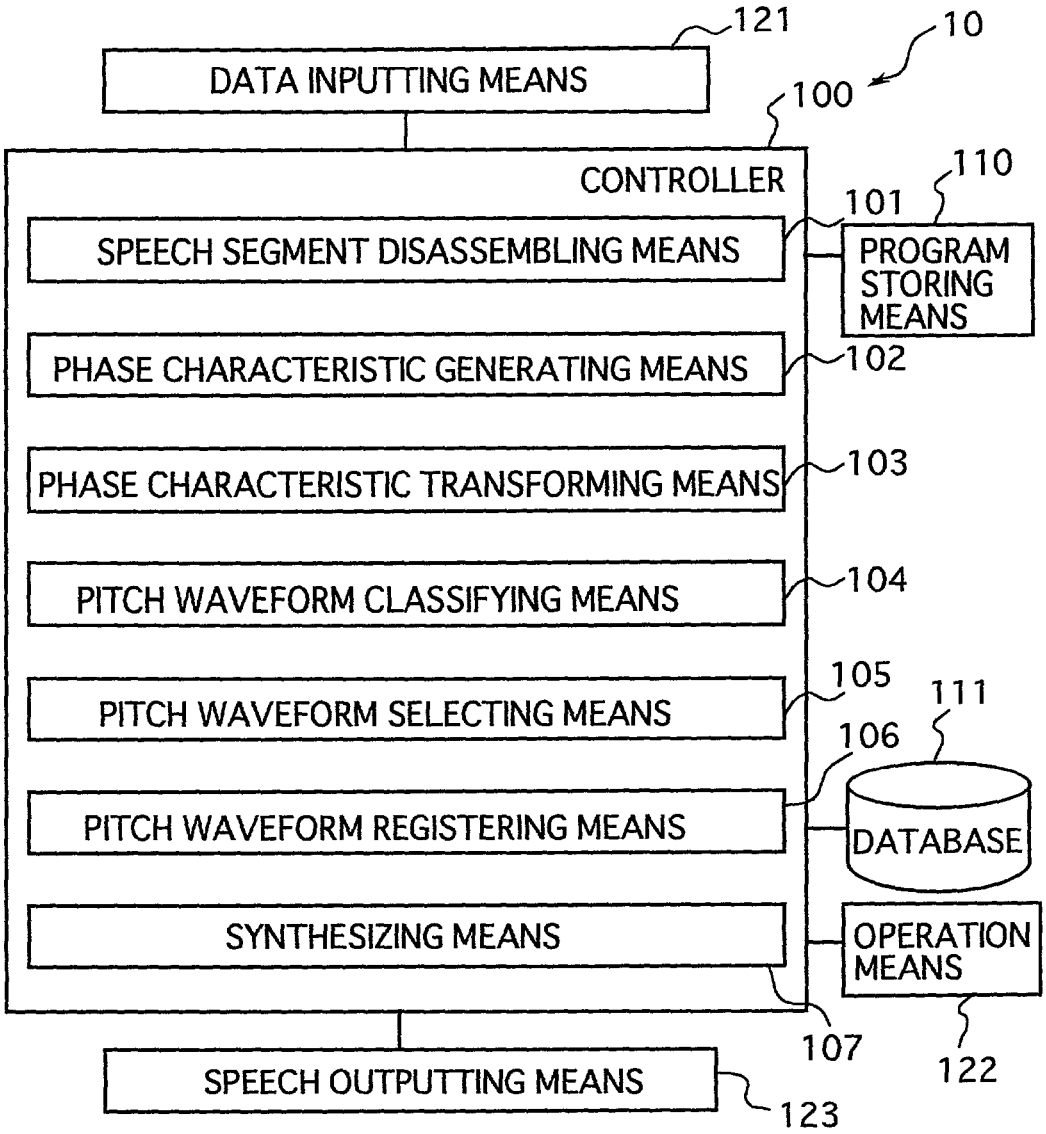
FIG. 1 is a block diagram of the embodiment of the speech synthesis apparatus according to the present invention.

Referring to the drawings, in particular FIGS. 1 to 7, there is shown a first embodiment of the speech synthesis apparatus and the speech synthesis method according to the present invention.

FIG. 1 is a block diagram of the embodiment of the speech synthesis apparatus according to the present invention. The speech synthesis apparatus 10 comprises a controller 100, e.g. a CPU (Central Processing Unit), for synthesizing a speech consisting of a plurality of speech segments such as CV (consonant-vowel) units or VCV (vowel-consonant-vowel) units each including at least one phoneme, program storing means 110, e.g. a memory, for storing a program including the steps mentioned later at large to be performed by the controller 100, a database 111, e.g. a Hard Disk, for storing data related to the speech segments, data inputting means 121, e.g. a microphone, for inputting a plurality of the speeches including the data to be stored in the database 111, operation means 122, e.g. a keyboard, for accepting manual operations by user to start disassembling the speech segments for registering the data related to the speech segments in the database 111, and speech outputting means 123, e.g. a network adaptor connected with a network such as the internet, for outputting the speech synthesized by the controller 100.

The controller 100, a principle portion of the speech synthesis apparatus 10, comprises speech segment disassembling means 101, phase characteristic generating means 102, phase characteristic transforming means 103, pitch waveform classifying means 104, pitch waveform selecting means 105, pitch waveform registering means 106, and synthesizing means 107.

The speech segment disassembling means 101 is operative to disassemble each of the speech segments into a plurality of pitch waveforms each having a phase characteristic and an amplitude characteristic. The phase characteristic generating means 102 is operative to generate an uniformed phase characteristic based on the phase characteristics of the pitch waveforms obtained by disassembling the speech segments. The phase characteristic transforming means 103 is operative to transform the phase characteristics of the pitch waveforms into the uniformed phase characteristic for each of the pitch waveforms. The pitch waveform classifying means 104 is operative to classify the pitch waveforms into a plurality of groups each consisting of a plurality of the pitch waveforms substantially identical in shape. The pitch waveform selecting means 105 is operative to select the pitch waveforms to be registered in the database 111 by comparing the pitch waveforms one another in shape in each of groups. The pitch waveform registering means 106 is operative to register the pitch waveforms in the database 111 by extracting one pitch waveform from among the pitch waveforms in each of the groups. The synthesizing means 107 is operative to synthesize the speech with the pitch waveforms registered in the database 111.

Figure 2:
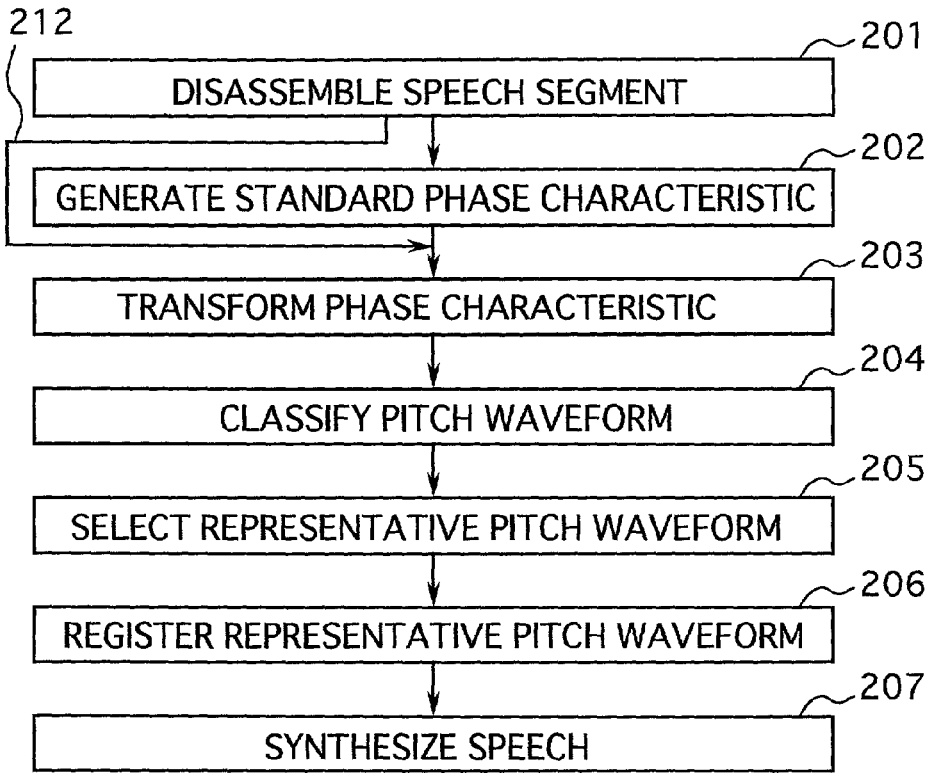
FIG. 2 is a flowchart of the embodiment of the speech synthesis method according to the present invention.

FIG. 2 is a flowchart of the embodiment of a speech synthesis method including steps each performed by the controller 100 in accordance with the program stored in the program storing means 110. In step 201, each of the speech segments constituting each of speeches inputted with data inputting means 121 is disassembled into a plurality of pitch waveforms each having a phase characteristic and an amplitude characteristic. In step 202, an uniformed phase characteristic is generated based on the phase characteristics of the pitch waveforms obtained by disassembling the speech segments. In addition, once the uniformed phase characteristic is generated, the step 202 may be passed as indicated with an arrow 212. In step 203, the phase characteristics of the pitch waveforms are transformed into the uniformed phase characteristic for each of the pitch waveforms. In step 204, the pitch waveforms are classified into a plurality of groups each consisting of a plurality of the pitch waveforms substantially identical in shape. In step 205, the pitch waveforms to be registered in the database 111 are selected by comparing the pitch waveforms one another in shape in each of groups. In step 206, the pitch waveforms are registered in the database 111 by extracting one pitch waveform from among the pitch waveforms in each of the groups. In step 207, the speech is synthesized with the pitch waveforms registered in the database 111.

Figure 3:
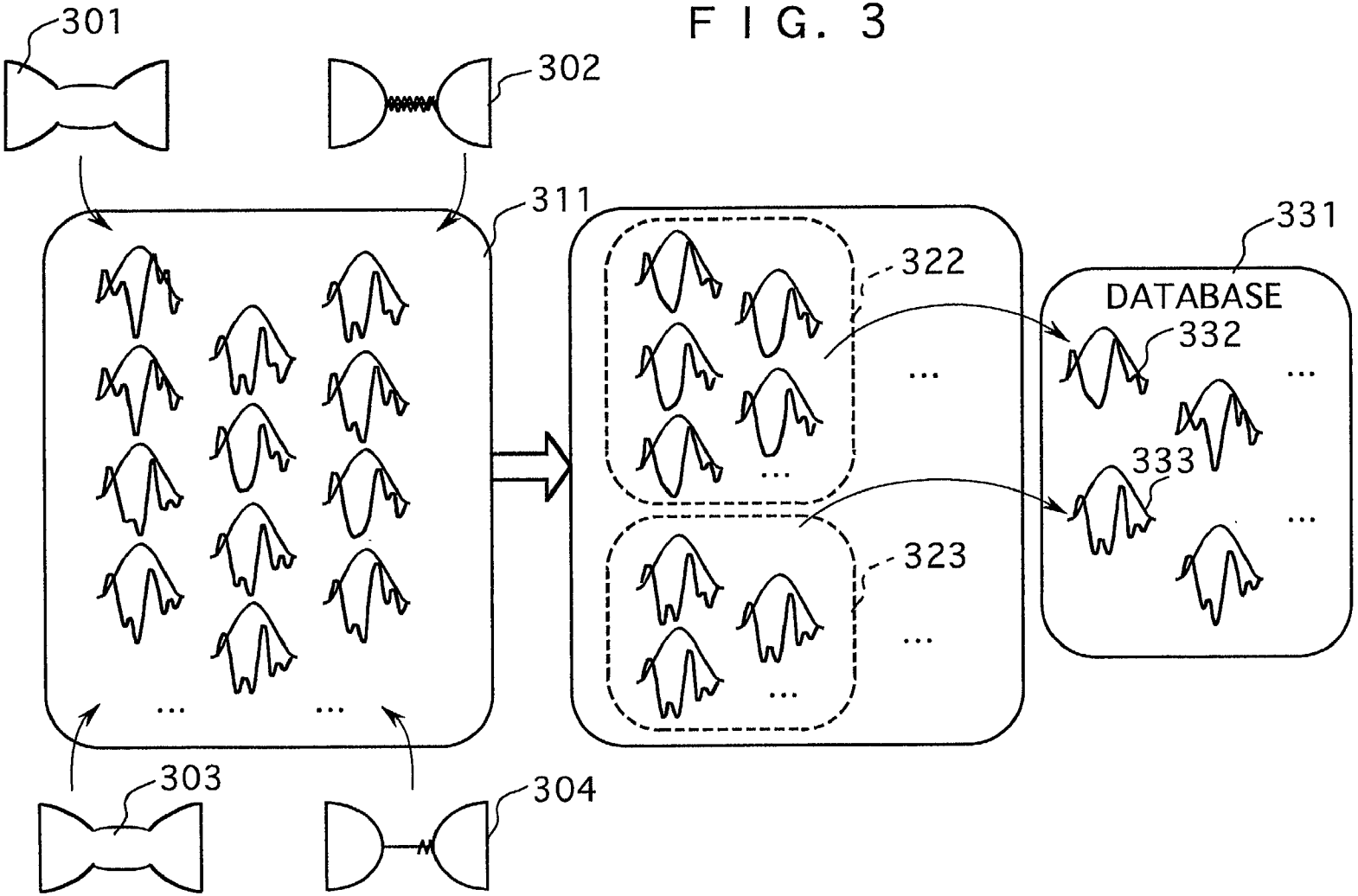
FIG. 3 is an explanatory view showing an example of the pitch waveforms.

FIG. 3 is an explanatory view showing an example of the pitch waveforms. The pitch waveforms are extracted from a plurality of speech segments 301, 302, 303 and 304 such as VCV (vowel-consonant-vowel) units each including at least one phoneme, and the pitch waveforms are then stored in a temporary database 311. The pitch waveforms are represented in time domain where the horizontal axis is a time axis. In the temporary database 311, the phase characteristics of the pitch waveforms are transformed into the uniformed phase characteristic, and the pitch waveforms are then classified into groups such as a first group 322 and a second group 323 by comparing the pitch waveforms one another in shape with the correlation coefficient. Further, the pitch waveforms to be registered in a representative pitch waveform database 331 as representative pitch waveforms are respectively selected form among the pitch waveforms in each of the groups. For example, a first representative pitch waveform 332 is selected as a representative of the first group 322 and a second representative pitch waveform 333 is selected as a representative of the second group 323, the first representative pitch waveform 332 and the second representative pitch waveform 333 are then registered in the representative pitch waveform database 331. In addition, the pitch waveforms in the temporary database 311 are then removed.

Figure 4:
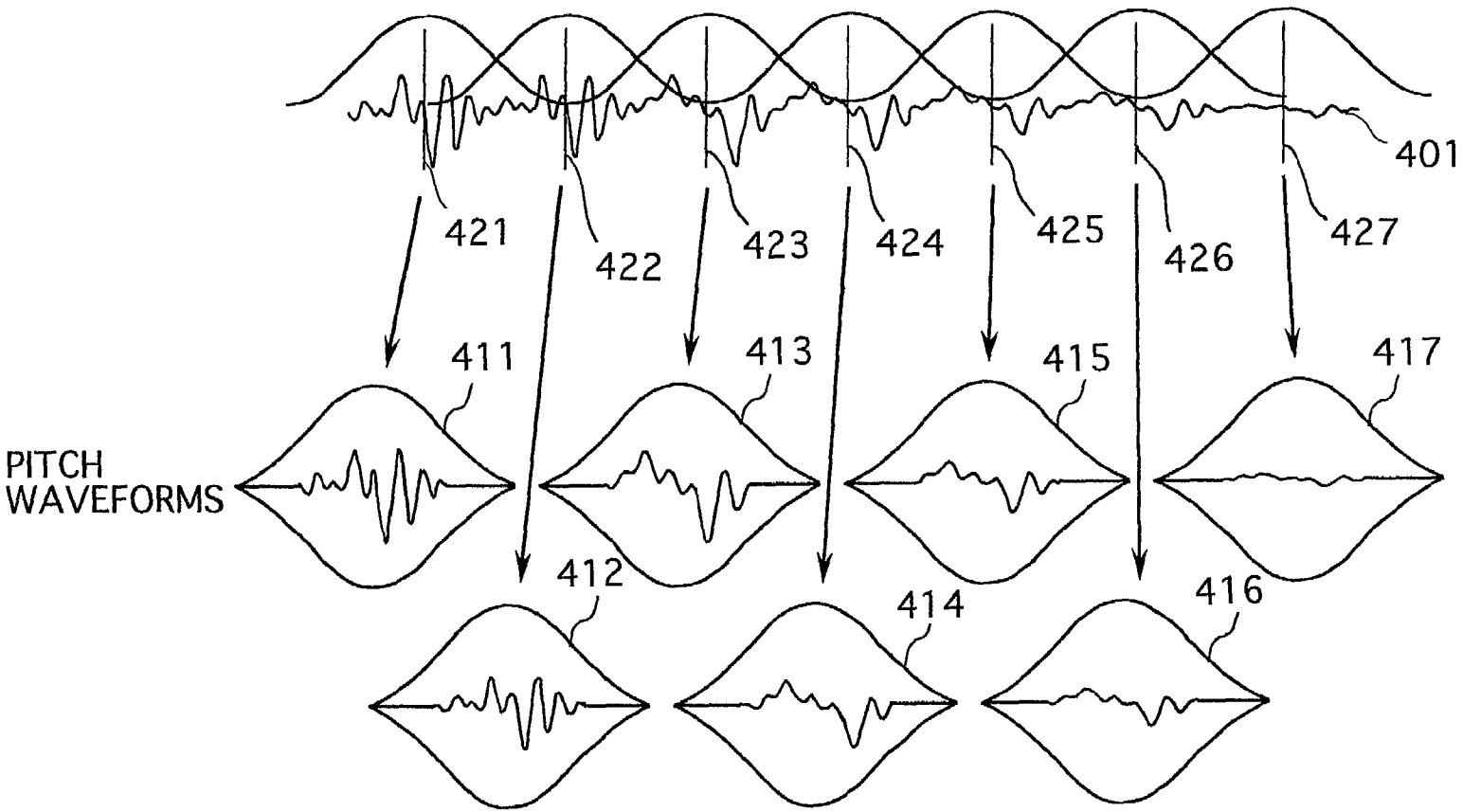
FIG. 4 is an explanatory view showing an example of the process of disassembling the speech segment into the pitch waveforms in the embodiment of the speech synthesis apparatus according to the present invention.

FIG. 4 is an explanatory view showing an example of a process of disassembling the speech segment into the pitch waveforms. The pitch waveforms 411, 412, 413, 414,415, 416 and 417 are represented each in the time domain where the horizontal axis is the time axis. A plurality of pitch mark position 421, 422,423, 424, 425, 426 and 427 indicate reference positions for extracting the pitch waveforms 411, 412,413,414,415,416 and 417 from the speech segment 401. The pitch mark positions 421 to 427 are manually or automatically marked on the waveform of the speech segment 401 in advance. Each of the pitch waveforms 411 to 417 is extracted from the voiced sound portion of the speech segment 401 based on the respective pitch mark position 421 to 427 with a window function, such as the Hanning window, having predetermined time length. The other speech segments constitute the speech are also disassembled into a plurality of pitch waveforms as described above.

Figure 5:
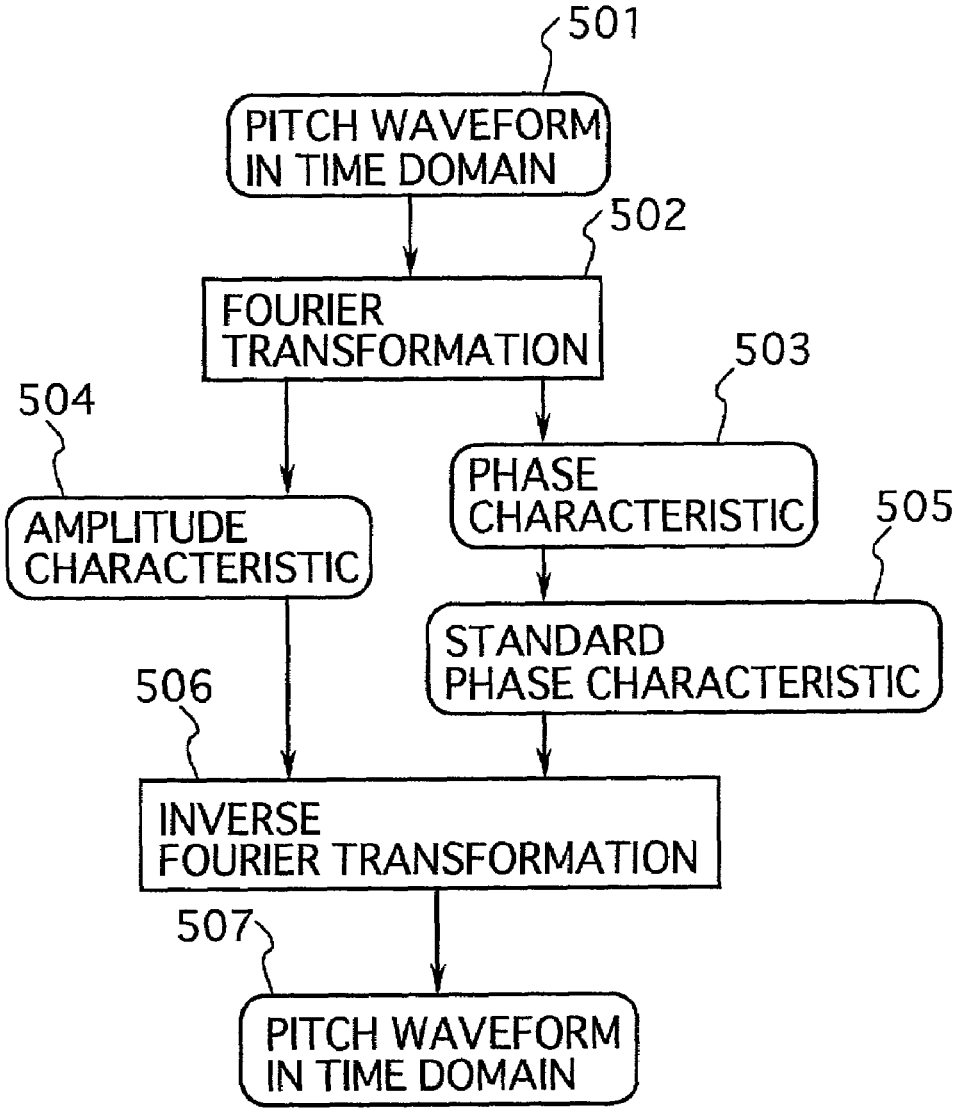
FIG. 5 is an explanatory view showing an example of the process of transforming the phase characteristic of the pitch waveform into the uniformed phase characteristic in the first embodiment of the speech synthesis apparatus according to the present invention.
Figure 6:
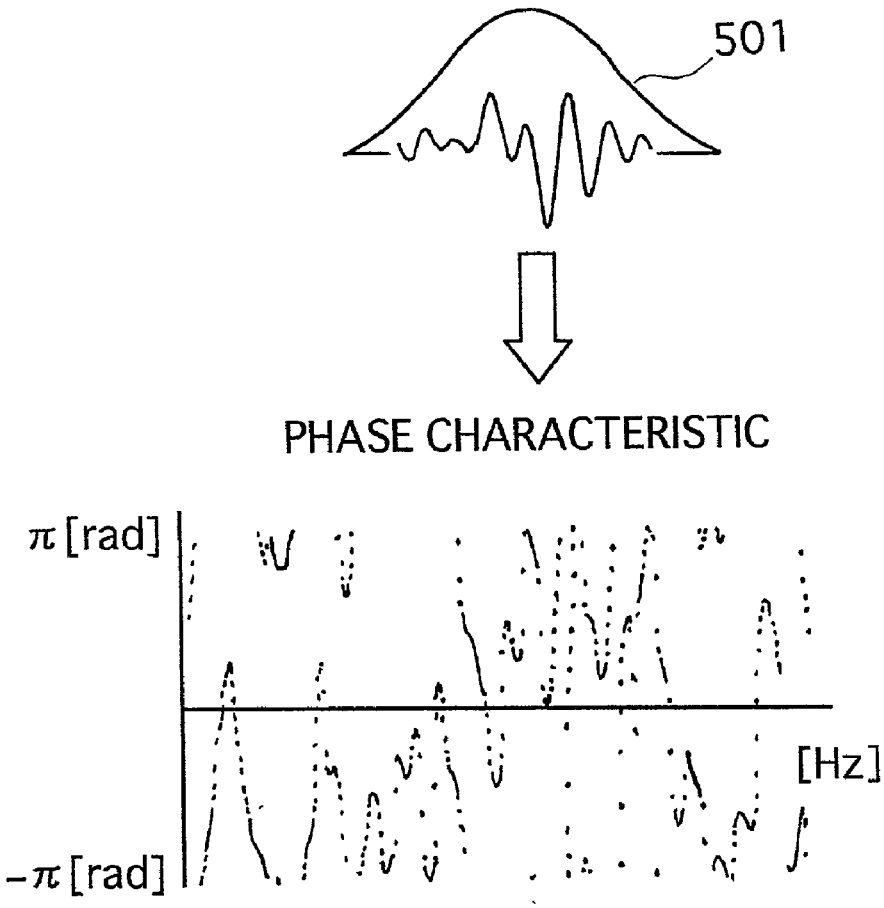
FIG. 6 is an explanatory view showing an example of the phase characteristic of the pitch waveform.

FIG. 5 is an explanatory view showing an example of a process of transforming the phase characteristic of the pitch waveform into the uniformed phase characteristic indicated as a standard phase characteristic. A Fourier transformation portion 502 for performing the Fourier transformation, and an inverse Fourier transformation portion 506 for performing the inverse Fourier transformation, constitute the phase characteristic transforming means 103 indicated in FIG. 1. The pitch waveform 501 is firstly transformed from the time domain to frequency domain by the Fourier transformation portion 502 to obtain a phase characteristic 503 and an amplitude characteristic 504 each having a frequency axis. The phase characteristic 503 of the pitch waveform is then transformed to the standard phase characteristic 505 generated based on a plurality of phase characteristics of the pitch waveforms obtained by disassembling the speech segments in advance. FIG. 6 shows an example of the phase characteristic of the pitch waveform having phases different from one another at respective frequencies. The amplitude characteristic 504 of the pitch waveform remains as the amplitude characteristic obtained by the Fourier transformation portion 502. The standard phase characteristic 505 and the amplitude characteristic 504 constitute the pitch waveform in the frequency domain. The pitch waveform in the frequency domain is then transformed from the frequency domain to the time domain by the inverse Fourier transformation portion 506 to obtain pitch waveform 507 in the time domain. The phase characteristics of the other pitch waveforms extracted from the speech segment are also transformed to the standard phase characteristic as described above, thereby increasing the degree of similarity between the pitch waveforms substantially identical in shape.

The pitch waveforms are then classified into a plurality of groups by comparing correlation coefficients each indicating the correlation between the two pitch waveforms. The correlation coefficient $M_{mn}$ for two given pitch waveforms $S_m$ and $S_n$ is determined by following Equation 1:

$$M_{mn} = \frac{\sum_{i=0}^{l} (Sm(i) \cdot Sn(i))}{\sqrt{\sum_{i=0}^{l} Sm(i)^2 \cdot \sum_{i=0}^{l} Sn(i)^2}} \quad \text{(Equation 1)}$$

where l is the length of the pitch waveform and is adjusted to the shorter one of the lengths of the two pitch waveforms $S_m$ and $S_n$. The correlation coefficient between the pitch waveforms may be replaced by the distance such as the Euclidean distance, the likelihood, and the other indexes indicating the correlation between the pitch waveforms for classifying the pitch waveforms.

The pitch waveforms to be registered in the database for synthesizing the speech, i.e. representative pitch waveforms, are respectively selected from among the pitch waveforms in respective groups. The selecting the representative pitch waveform in each of the groups is that, firstly determining a centroid of the pitch waveforms in the group in the same manner as producing the code book with the vector quantization, and then searching the closest pitch waveform to the centroid from among the pitch waveforms in the group.

The representative pitch waveforms selected as mentioned above are registered in the representative pitch waveform database 331. In addition, the representative pitch waveforms in the representative pitch waveform database 331 are associated with the speech segments to reassemble the speech segments for synthesizing the speech.

Figure 7:
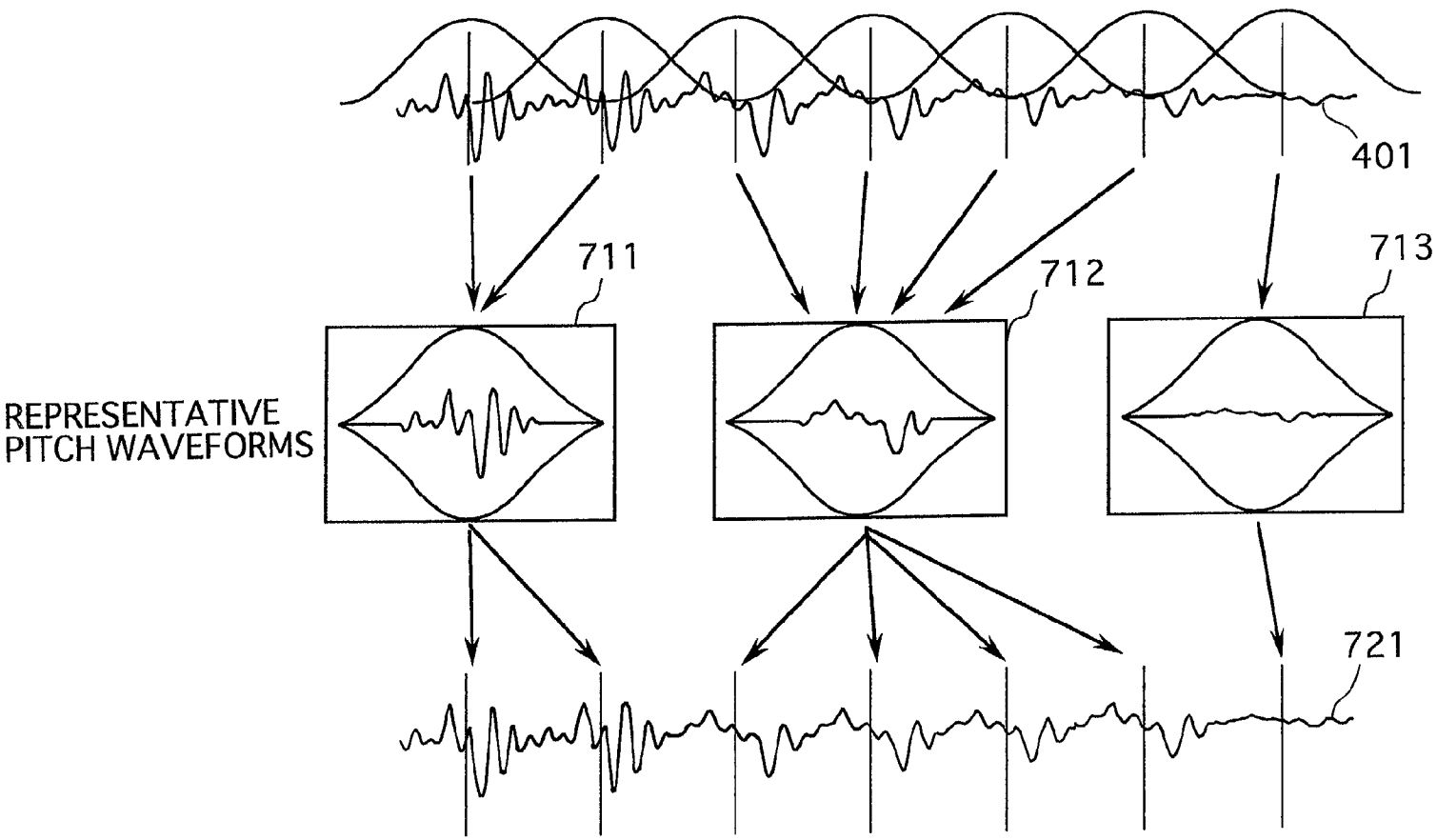
FIG. 7 is an explanatory view showing an example of the process of reassembling the speech segment from the pitch waveforms in the embodiment of the speech synthesis apparatus according to the present invention.

FIG. 7 is an explanatory view showing an example of a process of reassembling the speech segment from the pitch waveforms. The representative pitch waveforms 711, 712 and 713 are used as replacements for the original pitch waveforms extracted from the original speech segment 401. A new speech segment 721 is reassembled form the representative pitch waveforms 711, 712 and 713, and the other speech segments constituting the speech are also reassembled like as the speech segment 721, each of the speech segments are then transformed under the phonetic transformation such as the transformation in the rhythm, as the result that, the speech is synthesized with the representative pitch waveforms.

As stated above, according to the first embodiment of the speech synthesis apparatus, each of the speech segments is firstly disassembled into a plurality of the pitch waveforms each having the phase characteristic and the amplitude characteristic as shown in FIG. 4. In addition, the standard phase characteristic is generated based on the phase characteristics of the pitch waveforms obtained by disassembling the speech segments. The phase characteristics of the pitch waveforms are then transformed into the standardized phase characteristic for each of the pitch waveforms as shown in FIG. 5. The pitch waveforms are then classified into a plurality of the groups each consisting of a plurality of the pitch waveforms substantially identical in shape as shown in FIG. 3. The pitch waveforms are then registered in the representative pitch waveform database by extracting one pitch waveform from among the pitch waveforms in each of the groups as shown in FIG. 3. The speech is then synthesized with the pitch waveforms registered in the representative pitch waveform database by reassembling the respective speech segments with the representative pitch waveforms as shown in FIG. 7.

The first embodiment of the speech synthesis apparatus and the speech synthesis method thus constructed as previously mentioned leads to the fact that the differences in shape of the pitch waveforms are removed, thereby making it possible to reduce an amount of data in the database to a desired level. Further, the transforming operation of the phase characteristics of the pitch waveforms hardly affects the sound quality of the synthesized speech, thereby accomplishing speech synthesis with little degradation in sound quality.

Figure 8:
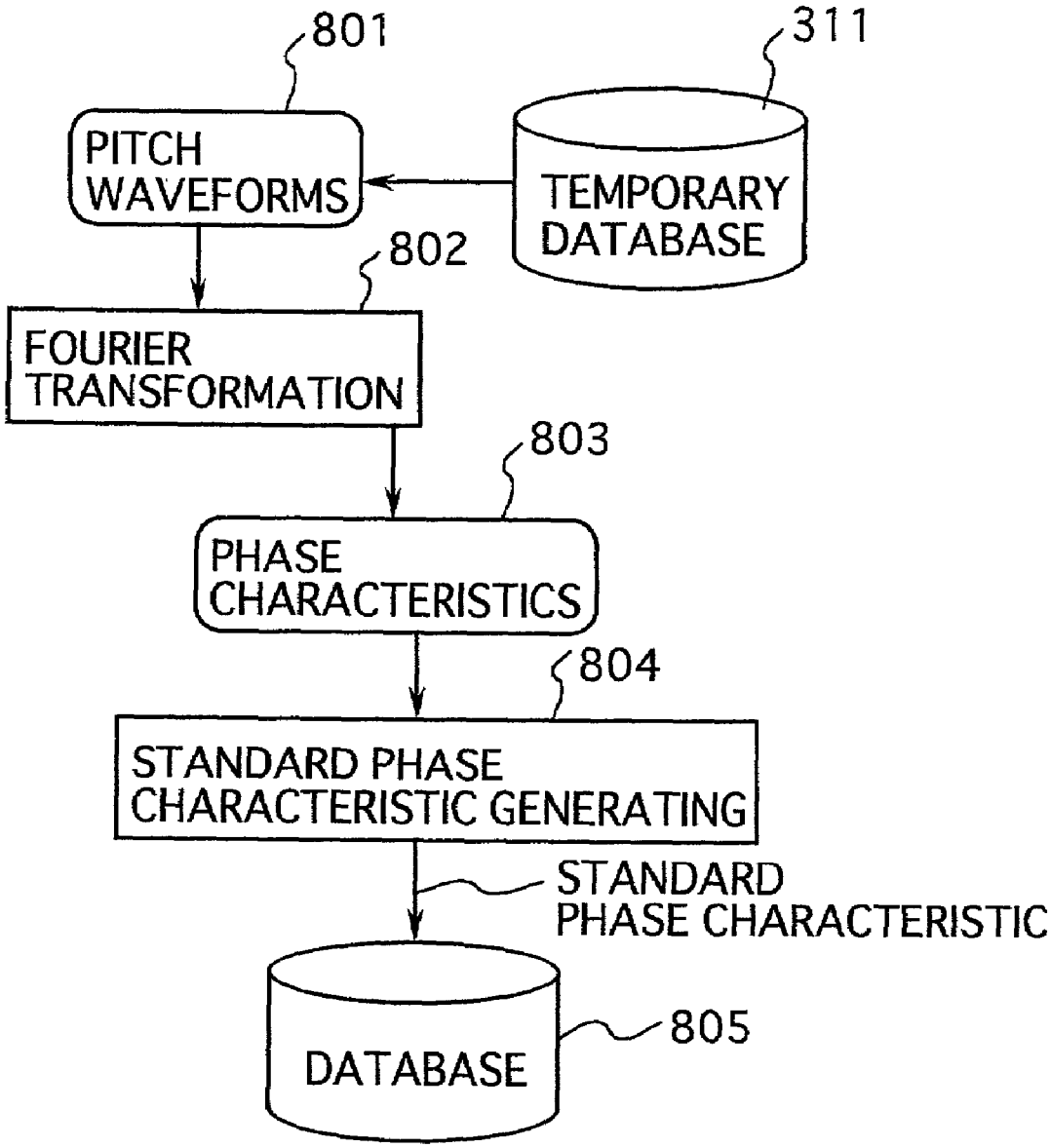
FIG. 8 is an explanatory view showing an example of the process of generating the uniformed phase characteristic in the second embodiment of the speech synthesis apparatus according to the present invention.
Figure 9:
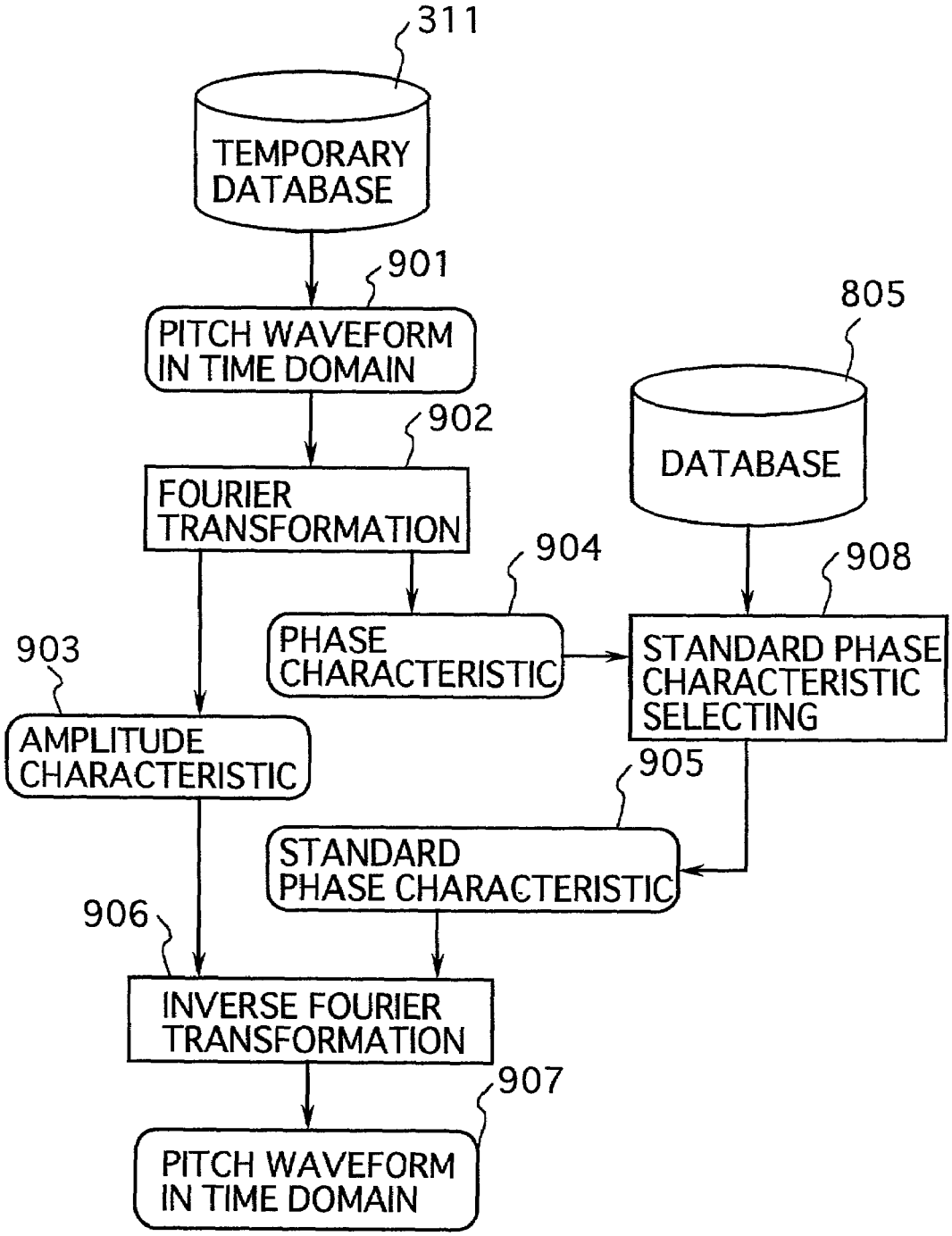
FIG. 9 is an explanatory view showing an example of the process of transforming the phase characteristic of the pitch waveform in the second embodiment of the speech synthesis apparatus according to the present invention.

Referring to the drawings, in particular FIGS. 8 and 9 additional to FIGS. 1 to 7, there is shown a second embodiment of the speech synthesis apparatus and the speech synthesis method according to the present invention.

The second embodiment of the speech synthesis apparatus is different form the first embodiment of the speech synthesis apparatus in that the phase characteristic generating means is operative to generate the uniformed phase characteristic with statistical process. The other components are the same as those of the first embodiment of the speech synthesis apparatus, and therefore the detailed descriptions thereof will be omitted.

FIG. 8 is an explanatory view of an example of the process of generating the uniformed phase characteristic indicated as a standard phase characteristic. The temporary database 311, the same one indicated in FIG. 3, is operative to store the pitch waveforms obtained by disassembling the speech segments constituting the speech. A Fourier transformation portion 802 for performing the Fourier transformation, and a standard phase characteristic generating portion 804 for generating the standard phase characteristic, constitute the phase characteristic generating means 102 indicated in FIG. 1. The pitch waveforms 801 in the temporary database 311 are firstly transformed from the time domain to the frequency domain by the Fourier transformation portion 802 to obtain the phase characteristics 803 each having a frequency axis. The standard phase characteristic generating portion 804 then generates a standard phase characteristic with an appropriate statistical process. The standard phase characteristic is then registered in a phase characteristic database 805.

The standard phase characteristic generating portion 804 will be then mentioned in detail. The amplitude characteristic A(w) and the phase characteristic P(w) of the pitch waveforms 801 in the frequency domain are represented with the real part R(w) and the imaginary part I(w) by following Equation 2 and Equation 3, $$A(w)=(R(w)^2+I(w)^2)^{1/2} \quad \text{(Equation 2)}$$

$$P(w)=tan^{-1}(I(w)/R(w)) \quad \text{(Equation 3)}$$

where w is the frequency in discreet value, and unit of the frequency is Hz. The standard phase characteristic generating portion 804 is operative to calculate the average of the phase characteristics Ps(w) at each frequency w for the pitch waveforms extracted from the speech segments, by following Equation 4, $$Ps(w) = (1/N)\sum_{i=1}^{N} Pi(w) \quad \text{(Equation 4)}$$

where N is number of the pitch waveforms. The set of the averages of the phase characteristics Ps(w) at every frequencies is registered in the phase characteristic database 805 as a candidate of the standard phase characteristic.

FIG. 9 is an explanatory view showing an example of a process of transforming the phase characteristic of the pitch waveform into the uniformed phase characteristic indicated as a standardized phase characteristic. A Fourier transformation portion 902 for performing the Fourier transformation, a standard phase characteristic selecting portion 908 for selecting a standard phase characteristic among the phase characteristics in the phase characteristic database 805, and an inverse Fourier transformation portion 906 for performing the inverse Fourier transformation, constitute the phase characteristic transforming means 103 indicated in FIG. 1. The pitch waveform 901 is firstly transformed from the time domain to the frequency domain by the Fourier transformation portion 902 to obtain a phase characteristic 904 and an amplitude characteristic 903 each having a frequency axis. The standard phase characteristic selecting portion 908 is operative to select one phase characteristic from among the phase characteristics in the phase characteristic database 805. The amplitude characteristic 903 of the pitch waveform remains as the amplitude characteristic obtained by the Fourier transformation portion 902. The standard phase characteristic 905 and the amplitude characteristic 903 constitute the pitch waveform in the frequency domain. The pitch waveform in the frequency domain is then transformed from the frequency domain to the time domain by the inverse Fourier transformation portion 906 to obtain pitch waveform 907 in the time domain. The phase characteristics of the other pitch waveforms extracted from the speech segment are also transformed to the standard phase characteristic as described above.

As stated above, according to the second embodiment of the speech synthesis apparatus, each of the speech segments is firstly disassembled into a plurality of the pitch waveforms each having the phase characteristic and the amplitude characteristic as shown in FIG. 4. In addition, each of the standard phase characteristics is generated by averaging the phase characteristics of the pitch waveforms obtained by disassembling the speech segments as shown in FIG. 8. The phase characteristics of the pitch waveforms are then transformed into the standard phase characteristic for each of the pitch waveforms as shown in FIG. 9. The pitch waveforms are then classified into a plurality of the groups each consisting of a plurality of the pitch waveforms substantially identical in shape as shown in FIG. 3. The pitch waveforms are then registered in the representative pitch waveform database by extracting one pitch waveform from among the pitch waveforms in each of the groups. The speech is then synthesized with the pitch waveforms registered in the representative pitch waveform database.

In addition, a plurality of the standard phase characteristics each may be generated in the each of groups consisting of a plurality of phase characteristics having similar characteristic.

Further, in the case of that a plurality of the standard phase characteristics are registered in the phase characteristic database 805, the standard phase characteristic which is the closest to each of the phase characteristic 904 is selected by the standard phase characteristic selecting portion 908.

The second embodiment of the speech synthesis apparatus and the speech synthesis method thus constructed as previously mentioned leads to the fact that an occurrence of an unusual waveform with energy concentration such as zero phase is avoided, and that changes in shape of the pitch waveforms can be small, thereby accomplishing speech synthesis with more stable and more natural sound quality than the first embodiment of those.

The standard phase characteristic is generated by averaging the phase characteristics of the pitch waveforms extracted from the speech segments in the above description, however, the speech synthesis apparatus and the speech synthesis method allow to generate the standard phase characteristic by selecting the closest one to the centroid from among the classified phase characteristics.

Figure 10:
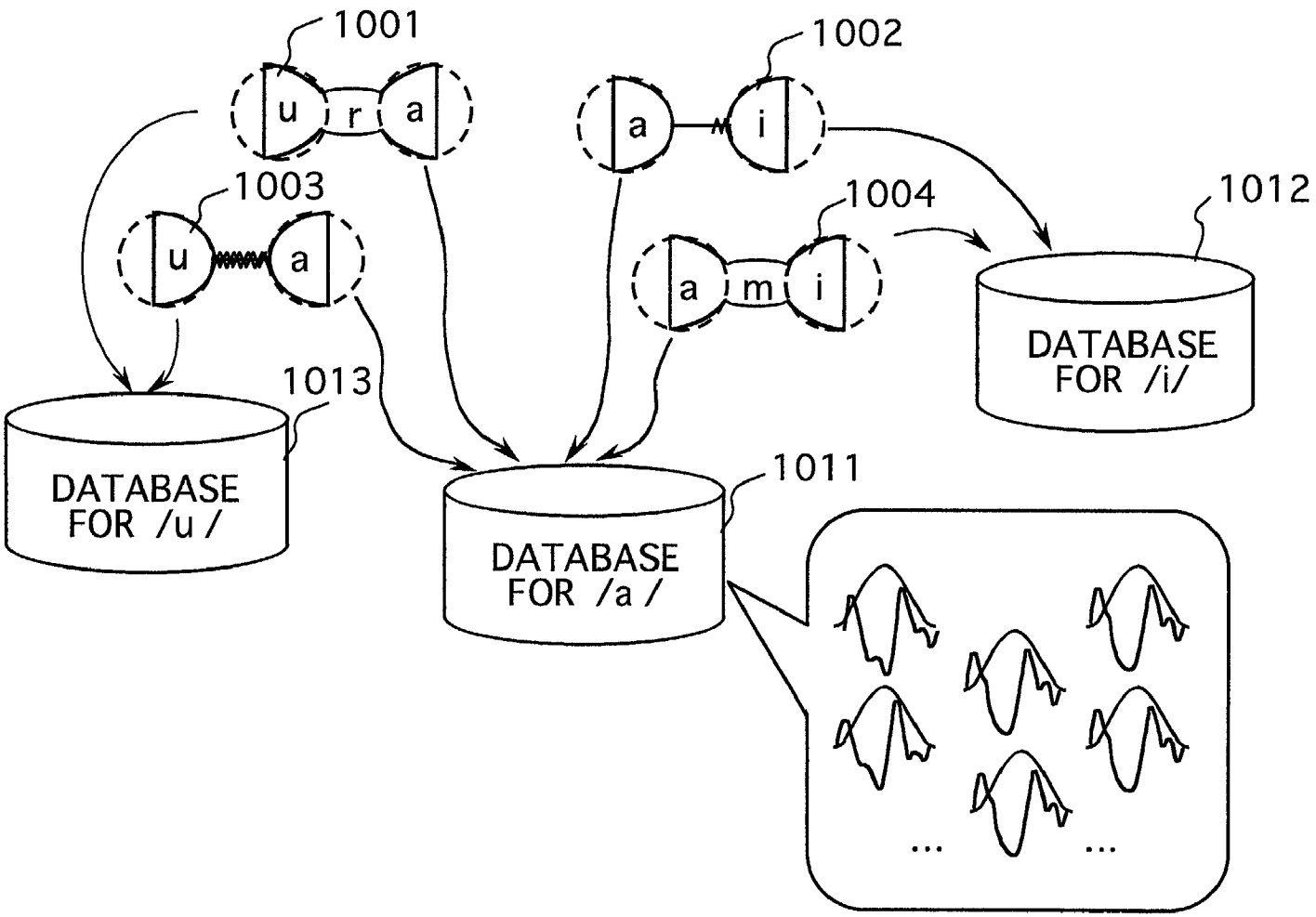
FIG. 10 is an explanatory view showing an example of the process of classifying the pitch waveforms based on the respective phoneme types in the third embodiment of the speech synthesis apparatus according to the present invention.

Referring to the drawings, in particular FIG. 10 additional to FIGS. 1 to 9, there is shown a third embodiment of the speech synthesis apparatus and the speech synthesis method according to the present invention.

The third embodiment of the speech synthesis apparatus is different form the second embodiment of the speech synthesis apparatus in that the pitch waveform classifying means is operative to classify the pitch waveforms based on respective phoneme types in advance. The other components are the same as those of the second embodiment of the speech synthesis apparatus, and therefore the detailed descriptions thereof will be omitted.

FIG. 10 is an explanatory view showing an example of the process of classifying the pitch waveforms. The speech segments 1001, 1002, 1003 and 1004, the VCV units respectively including the phonemes "ura", "a i", "u a", and "ami", are disassembled into a plurality of the pitch waveforms. The pitch waveforms are classified based on the respective phoneme types to store into the respective temporary databases, a database for /a/ 1011, a database for /i/ 1012, a database for u/1013, and the other databases not shown in FIG. 10.

It is possible that enormous number of the pitch waveforms extracted from the speech segments are into one set together to collectively classify the pitch waveforms substantially identical in shape, it leads to a waste of time due to the low working efficiency. Thereupon, the pitch waveforms extracted from the speech segments are respectively stored in a plurality of temporary databases prepared for respective phoneme types in advance. The speech segments 1001, 1002, 1003 and 1004 are respectively marked with phoneme boundaries thereon to indicate the respective phoneme types of the pitch waveforms in advance, the pitch waveforms are then classified based on the respective phoneme types which the respective pitch waveforms belong to. Thereby, the pitch waveforms are temporary stored in the temporary databases 1011, 1012 and 1013 associated with respective phoneme types as vowels: /a/, /i/, /u/, /e/ and /o/, nasal sound: /n/, semivowels: /w/ and /y/, and voiced consonant: /m/, /n/, /r/, /z/, /j/, /b/, /d/, /g/ and /v/. The phase characteristics of the pitch waveforms are then transformed into respective uniformed phase characteristics for respective phoneme types, further the pitch waveforms are classified into groups. Thereafter, each of the representative pitch waveforms is then selected from among the pitch waveforms in each of groups, and these representative pitch waveforms are then assembled into the speech segment.

In addition, the standard phase characteristics are determined from among the phase characteristics of the pitch waveforms in each of the temporary databases 1011, 1012 and 1013.

The third embodiment of the speech synthesis apparatus and the speech synthesis method thus constructed as previously mentioned leads to the fact that the amount of computation for classifying the pitch waveforms can be substantially decreased.

Figure 11:
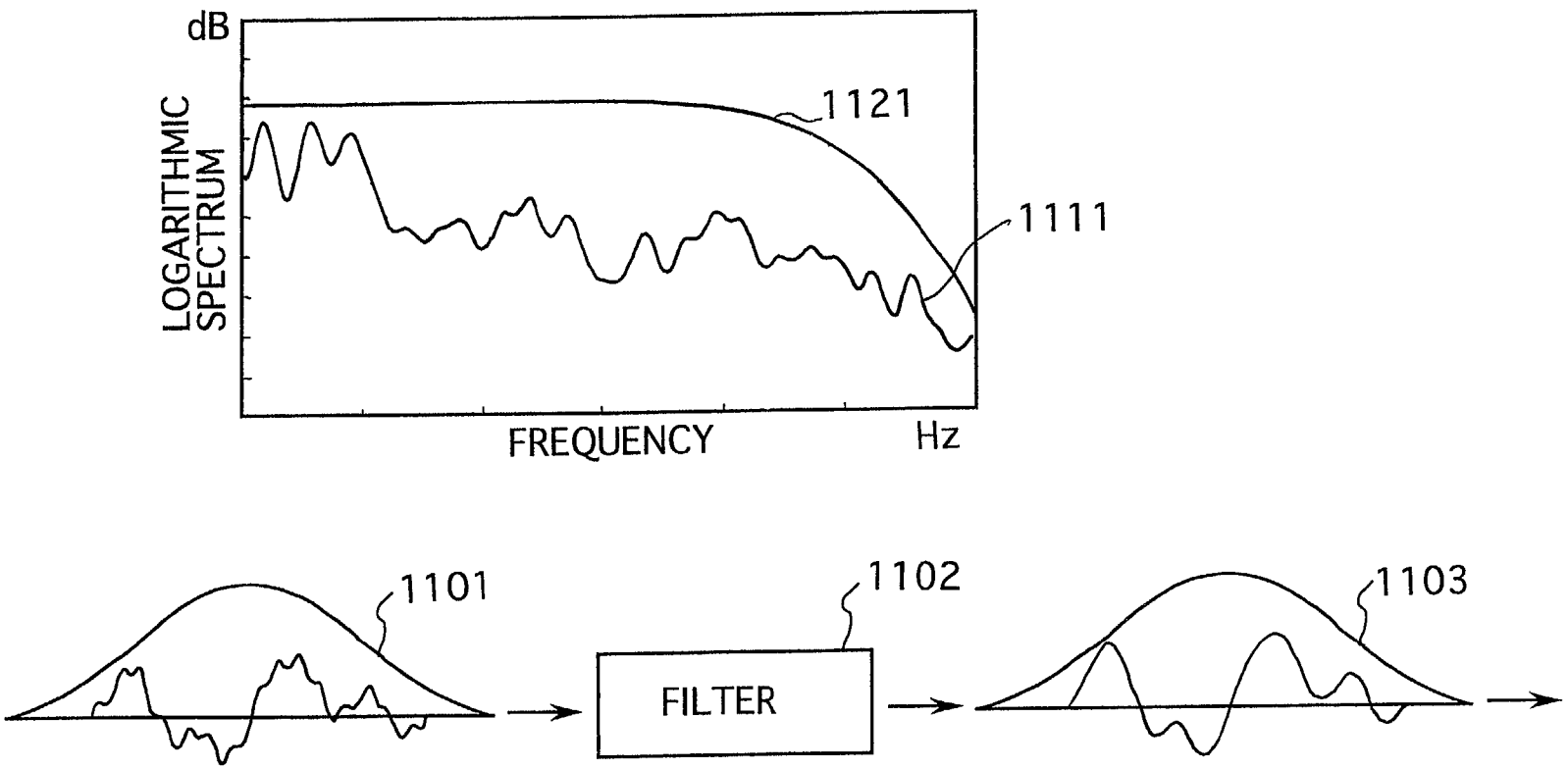
FIG. 11 is an explanatory view showing an example of the process of weighting the pitch waveforms at the frequencies in the fourth embodiment of the speech synthesis apparatus according to the present invention.

Referring to the drawings, in particular FIG. 11 additional to FIGS. 1 to 10, there is shown a fourth embodiment of the speech synthesis apparatus and the speech synthesis method according to the present invention.

The fourth embodiment of the speech synthesis apparatus is different form the third embodiment of the speech synthesis apparatus in that the pitch waveform classifying means is operative to classify the pitch waveforms by comparing the pitch waveforms weighted in amplitude characteristic at respective frequencies only for comparing. The other components are the same as those of the third embodiment of the speech synthesis apparatus, and therefore the detailed descriptions thereof will be omitted.

FIG. 11 is an explanatory view showing an example of the process of weighting the pitch waveform in amplitude characteristic. The pitch waveform 1101 is one of the pitch waveforms extracted from the speech segment and transformed in the phase characteristic. The amplitude characteristic 1111 of the pitch waveform 1101 is obtained with the Fourier transformation when the pitch waveform 1101 is transformed from the time domain to the frequency domain. The weight 1121, an amplitude gain to be multiplied by the amplitude characteristic 1111, is predetermined at respective frequencies according to the significance at respective frequencies. The filter 1102, weighting means for weighting the pitch waveforms at each frequencies, is operative to multiply the amplitude characteristic 1111 by the weight 1121 at each frequency. The pitch waveform weighted in frequency domain, i.e. the pitch waveform having the amplitude characteristic weighted at respective frequencies, is transformed from the frequency domain to the time domain with inverse Fourier transformation by the filter 1102, therefore, the weighted pitch waveform 1103 for only comparing is obtained.

The pitch waveforms weighted in amplitude characteristic are compared in shape by evaluating the correlation coefficients indicating the degree of similarity between the pitch waveforms. The closer the correlation coefficient is to 1, the higher the degree of similarity between the pitch waveforms is. The pitch waveforms having a high degree of similarity therebetween than the predetermined degree, such pitch waveforms can be interchanged at the time of reassembling the speech segment with little diminution of naturalness, i.e. the degradation in sound is not leads to.

How to weight will then be described. In the case that an high degree of similarity are required for classifying the pitch waveforms in order to retain the continuity of a sound not at high frequencies but at low frequencies, the weights are given at low frequencies. In FIG. 11, the amplitude characteristic 1111 is multiplied by the amplitude gain 1121 to weight at low frequencies for only comparing the pitch waveforms. The significance of the amplitude characteristic is different at each frequency band as mentioned above, therefore, the pitch waveforms are compared with the pitch waveforms whose amplitude characteristic has been thus given a weight at each frequency band. This is the same as the process in which the pitch waveform 1101 is filtered through a low-pass filter 1102 to obtain the pitch waveform 1103 having the influence of high frequencies suppressed. The pitch waveforms thus filtered are used for only comparing the pitch waveform, the pitch waveforms with no weight are then actually classified, and the representative pitch waveforms are also selected from among the pitch waveforms with no weight.

The fourth embodiment of the speech synthesis apparatus and the speech synthesis method thus constructed as previously mentioned leads to the fact that it is possible to achieve less data capacity consistent with high sound quality. Particularly, not only ignoring of the differences in the pitch waveform shape within unimportant frequency band, but also maintenance of the identity of the pitch waveforms within important frequency band can be achieved for less data capacity and high sound quality.

Figure 12:
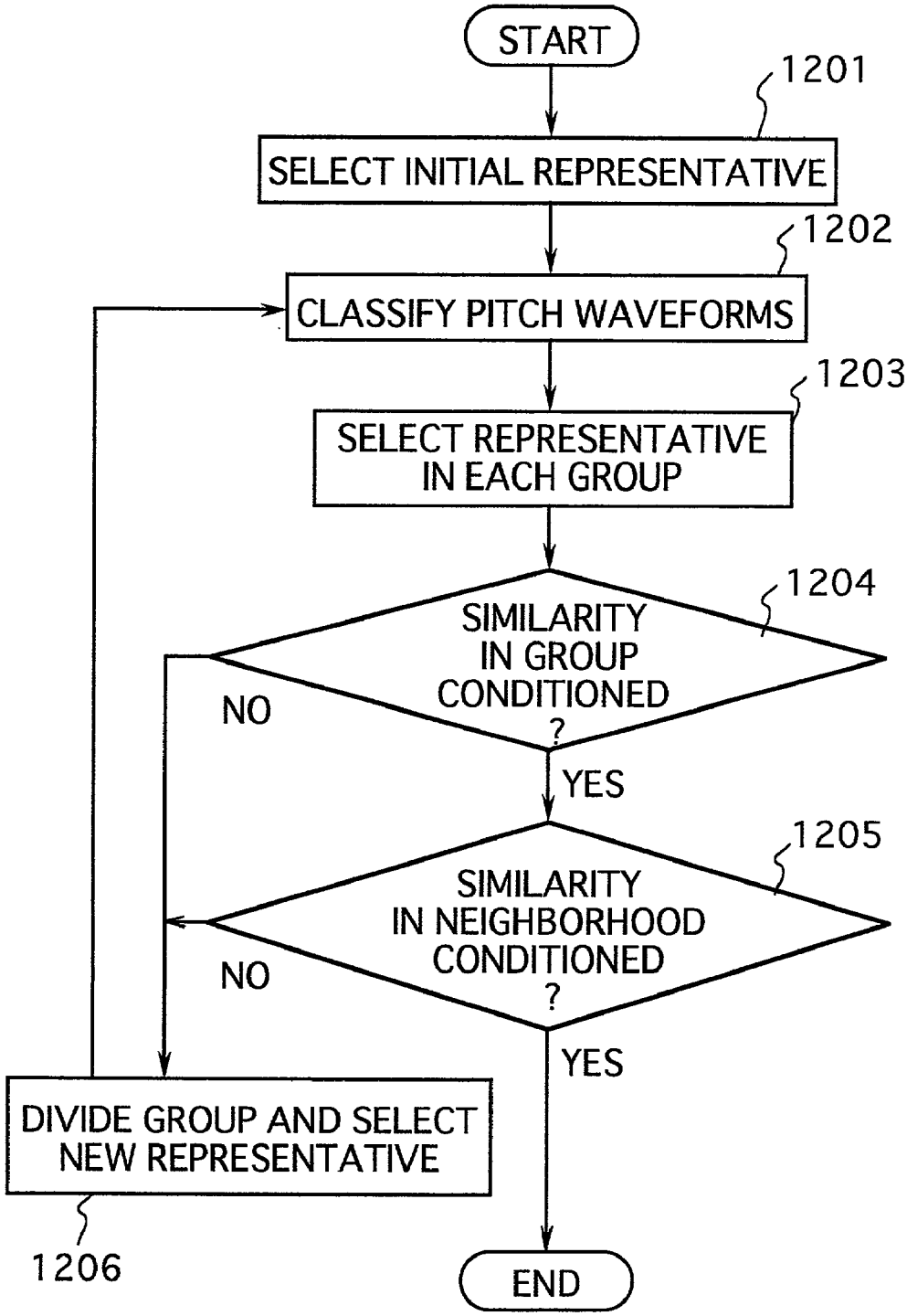
FIG. 12 is a flowchart showing an example of the process of selecting the representatives of the pitch waveforms in the fifth embodiment of the speech synthesis apparatus according to the present invention.
Figure 13:
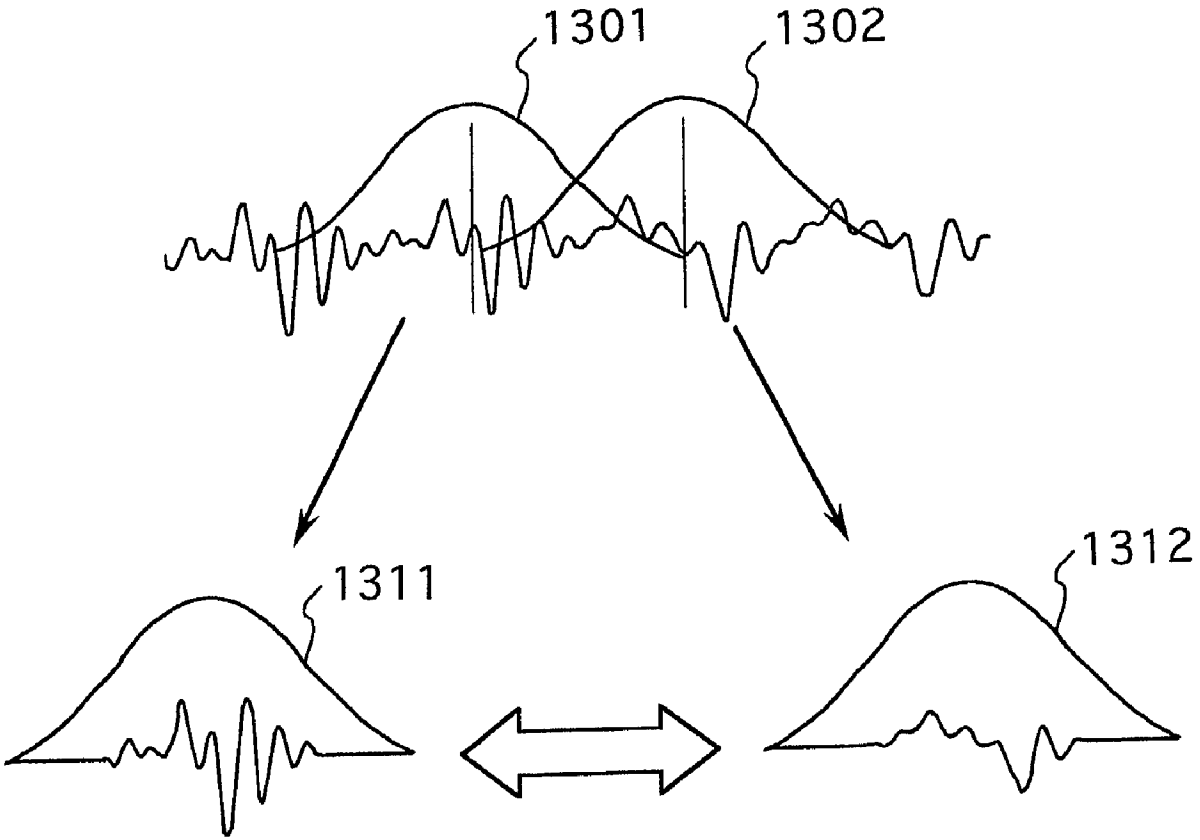
FIG. 13 is an explanatory view showing an example of comparing the pitch waveforms to be in neighborhood in the fifth embodiment of the speech synthesis apparatus according to the present invention.

Referring to the drawings, in particular FIGS. 12 and 13 additional to FIGS. 1 to 11, there is shown a fifth embodiment of the speech synthesis apparatus and the speech synthesis method according to the present invention.

The fifth embodiment of the speech synthesis apparatus is different form the fourth embodiment of the speech synthesis apparatus in that the pitch waveform selecting means is operative to compare the pitch waveforms to be in neighborhood when the speech is synthesized. The other components are the same as those of the fourth embodiment of the speech synthesis apparatus, and therefore the detailed descriptions thereof will be omitted.

FIG. 12 is a flowchart showing an example of the process of selecting the representatives of the pitch waveforms. In step 1201, an appropriate number of representative pitch waveforms in initial state are arbitrarily selected from among the pitch waveforms stored in the temporary database. In step 1202, the pitch waveforms are classified into a plurality of groups each consisting of a plurality of the pitch waveforms substantially identical in shape. The number of the groups is the same as the number of the representatives. In step 1203, the closest pitch waveform to the centroid in each group is newly selected as the representatives. The newly selected representatives are judged whether satisfy conditions. In step 1204, it is judged whether the degree of similarity between each of the representatives and each of the pitch waveforms belonging to its group is within a predetermined range. In step 1205, it is also judged whether the degree of similarity between representatives to be in neighborhood when a speech segment is reassembled is within a range determined by the degree of similarity between the original pitch waveforms. In step 1206, when the conditions are not satisfied, the group is divided into two groups, and a representative is then newly selected in each of the groups. The above judgements, the judgement about the similarity in each of groups and the judgement about the similarity in neighborhood, are repeated until the conditions are satisfied to finally select the representatives.

FIG. 13 is an explanatory view showing an example of a process of comparing the representatives of the pitch waveforms to be in neighborhood. Two original pitch waveforms 1301 and 1302 in neighborhood in an original speech segment are to be replaced with the representatives 1311 and 1312. It is judged whether the degree of similarity between the representatives 1311 and 1312 satisfies the condition. For example, using a correlation coefficient as the degree of similarity, when the correlation coefficient between the original continuous pitch waveforms 1301 and 1302 is 0.9, the correlation coefficient between the representatives 1311 and 1312 must be at least $0.9\alpha$. The $\alpha$ is a determined coefficient for predetermining the threshold $0.9\alpha$ and satisfies $0<\alpha<1$. Until this condition is satisfied, a series of the process of classifying the pitch waveforms and selecting the representatives are repeated.

The sixth embodiment of the speech synthesis apparatus and the speech synthesis thus constructed as previously mentioned leads to the fact that the speech can be reassembled with the continuity between the adjacent pitch waveforms maintained, thereby further reducing the degradation in sound quality.

In addition, although the speech segments are VCV units in the above description, however, the speech synthesis apparatus and the speech synthesis method allow to use the other kinds of units, such as CV units, CVC units.

Further, the speech synthesis apparatus and the speech synthesis method can adapt for extracting the pitch waveforms from any of natural voices to synthesize the natural voices.

Still further, although the closest pitch waveform to the centroid is selected as the representative in each of the groups in the above description, the speech synthesis apparatus and the speech synthesis method allow to use the centroid itself as the representative in each of the groups.

Further the more, although the average of the phase characteristics is used as the standard characteristic in the above description, the speech synthesis apparatus and the speech synthesis method allow to use centroid or the closest phase characteristic to the centroid as the standard characteristic.

Further the more, a plurality of the temporary databases for every phoneme are used for store the pitch waveforms extracted from the speech segment in the above description, the speech synthesis apparatus and the speech synthesis method allow to use physical one database logically divided into a plurality of areas.

Further the more, the amplitude characteristic in the frequency domain is used for comparing the pitch waveforms in the above description, the speech synthesis apparatus and the speech synthesis method allow to compare the pitch waveforms filtered in time domain.

Further the more, the correlation coefficient is used as the index indicating the degree of similarity between the representatives of the pitch waveforms for selecting the representative pitch waveforms in the above description, the speech synthesis apparatus and the speech synthesis method allow to use a spectrum distance, and the other kinds of indexes indicating the degree of similarity between the representatives of the pitch waveforms.

Further the more, speech segment disassembling means 101, phase characteristic generating means 102, phase characteristic transforming means 103, pitch waveform classifying means 104, pitch waveform selecting means 105, and pitch waveform registering means 106 constitute a pitch waveform registering apparatus for registering a plurality of the pitch. In the pitch waveform registering apparatus, the respective speech segments are first disassembled into a plurality of pitch waveforms each having a phase characteristic, a plurality of uniformed phase characteristics are then generated based on the phase characteristics of the pitch waveforms obtained by disassembling the speech segments, the respective phase characteristics of the pitch waveforms are then transformed into the uniformed phase characteristic, the pitch waveforms are then classified into a plurality of groups each consisting of a plurality of the pitch waveforms substantially identical in shape, the pitch waveforms to be registered in the database are then selected by comparing the pitch waveforms, the pitch waveforms are then registered in a database by extracting one pitch waveform from among the pitch waveforms in each of said groups. The speech may be synthesized with the pitch waveforms registered in the database by the other apparatus.

From the above detailed description, it will be understood that the speech synthesis apparatus and the speech synthesis method as previously mentioned can synthesize a natural speech using a relatively small database capacity.

What is claimed is:

1. A speech synthesis apparatus for synthesizing a speech consisting of a plurality of speech segments each including at least one phoneme, comprising:

a database for storing data related to said speech segments;

speech segment disassembling means for disassembling each of said speech segments into a plurality of pitch waveforms each having a phase characteristic;

phase characteristic generating means for generating a uniformed phase characteristic from said phase characteristics of said pitch waveforms by averaging said phase characteristics of said pitch waveforms obtained by said speech segment disassembling means;

phase characteristic transforming means for transforming said phase characteristics of said pitch waveforms into said uniformed phase characteristic generated by said phase characteristic generating means;

pitch waveform classifying means for classifying said pitch waveforms into a plurality of groups each consisting of a plurality of said pitch waveforms substantially identical in shape;

pitch waveform registering means for registering said pitch waveforms in said database by extracting one pitch waveform from among said pitch waveforms in each of said groups; and synthesizing means for synthesizing said speech with said pitch waveforms registered in said database.

2. The speech synthesis apparatus as set forth in claim 1, in which said pitch waveform classifying means is operative to classify said pitch waveforms based on respective phoneme types.

3. The speech synthesis apparatus as set forth in claim 1, in which said pitch waveform classifying means is operative to classify said pitch waveforms by comparing said pitch waveforms weighted in amplitude characteristic at respective frequencies only for comparing.

4. The speech synthesis apparatus set forth in claim 1, which further comprises pitch waveform selecting means for selecting said pitch waveforms to be registered in said database by comparing said pitch waveforms to be in neighborhood each other when said speech is assembled.

5. A speech synthesis method of synthesizing a speech consisting of a plurality of speech segments each including at least one phoneme, comprising:

a speech segment disassembling step of disassembling each of said speech segments into a plurality of pitch waveforms each having a phase characteristic;

a phase characteristic generating step of generating a uniformed phase characteristic from said phase characteristics of said pitch waveforms by averaging said phase characteristics of said pitch waveforms obtained in said speech segment disassembling step;

a phase characteristic transforming step of transforming said phase characteristics of said pitch waveforms into said uniformed phase characteristic generated in said phase characteristic generating step;

a pitch waveform classifying step of classifying said pitch waveforms into a plurality of groups;

a pitch waveform registering step of registering said pitch waveforms in a database by extracting one pitch waveform from among said pitch waveforms in each of said groups; and a synthesizing step of synthesizing said speech with said pitch waveforms registered in said database.

6. The speech synthesis method as set forth in claim 5 in which said pitch waveform classifying step is of classifying said pitch waveforms based on respective phoneme types.

7. The speech synthesis method as set forth in claim 5, in which said pitch waveform classifying step is of classifying said pitch waveforms by comparing said pitch waveforms weighted in amplitude characteristic at respective frequencies only for comparing.

8. The speech synthesis method set forth in claim 5, which further comprises pitch waveform selecting step of selecting said pitch waveforms to be registered in said database by comparing said pitch waveforms to be in neighborhood each other when said speech is assembled.

9. A pitch waveform registering apparatus for registering a plurality of pitch waveforms constituting a plurality of speech segments each including at least one phoneme into a database for storing data related to said speech segments, said pitch waveforms to be used for synthesizing a speech consisting of said speech segments, comprising:

speech segment disassembling means for disassembling each of said speech segments into a plurality of pitch waveforms each having a phase characteristic;

phase characteristic generating means for generating a uniformed phase characteristic from said phase characteristics of said pitch waveforms by averaging said phase characteristics of said pitch waveforms obtained by said speech segment disassembling means;

phase characteristic transforming means for transforming said phase characteristics of said pitch waveforms into said uniformed phase characteristic generated by said phase characteristic generating means;

pitch waveform classifying means for classifying said pitch waveforms into a plurality of groups each consisting of a plurality of said pitch waveforms substantially identical in shape; and pitch waveform registering means for registering said pitch waveforms in said database by extracting one pitch waveform from among said pitch waveforms in each of said groups.

10. A pitch waveform registering method of registering a plurality of pitch waveforms constituting a plurality of speech segments each including at least one phoneme into a database for storing data related to said speech segments, said pitch waveforms to be used for synthesizing a speech consisting of said speech segments, comprising:

a speech segment disassembling step of disassembling each of said speech segments into a plurality of pitch waveforms each having a phase characteristic;

a phase characteristic generating step of generating a uniformed phase characteristic from said phase characteristics of said pitch waveforms by averaging said phase characteristics of said pitch waveforms obtained in said speech segment disassembling step;

a phase characteristic transforming step of transforming said phase characteristics of said pitch waveforms into said uniformed phase characteristic generated in said phase characteristic generating step;

a pitch waveform classifying step of classifying said pitch waveforms into a plurality of groups each consisting of a plurality of said pitch waveforms substantially identical in shape; and a pitch waveform registering step of registering said pitch waveforms in a database by extracting one pitch waveform from among said pitch waveforms in each of said groups.

* * * * *

UNITED STATES PATENT AND TRADEMARK OFFICE

CERTIFICATE OF CORRECTION

PATENT NO. : 7,016,840 B2
APPLICATION NO. : 09/953989
DATED : March 21, 2006
INVENTOR(S) : Ryo Mochizuki et al.

It is certified that error appears in the above-identified patent and that said Letters Patent is hereby corrected as shown below:

Column 11, line 48, please delete “u/ 1013”, and insert therefor --/u/ 1013--.

Signed and Sealed this

Twelfth Day of September, 2006

JON W. DUDAS
*Director of the United States Patent and Trademark Office*